US006497181B1

(12) United States Patent
Manole et al.

(10) Patent No.: US 6,497,181 B1
(45) Date of Patent: Dec. 24, 2002

(54) FLAMELESS TRACER AMMUNITION

(75) Inventors: Leon Manole, Great Meadows, NJ (US); Stewart Gilman, Wharton, NJ (US); Ernest L. Logsdon, Jr., Newton, NJ (US)

(73) Assignee: The Government of the United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/095,342

(22) Filed: Mar. 11, 2002

Related U.S. Application Data

(60) Provisional application No. 60/337,751, filed on Dec. 4, 2001.

(51) Int. Cl.[7] ..... F42B 12/38; F42B 12/40

(52) U.S. Cl. ..... 102/513; 362/34

(58) Field of Search ..... 102/395, 458, 102/502, 513, 529, 498; 362/34

(56) References Cited

U.S. PATENT DOCUMENTS

| | | | | | |
|---|---|---|---|---|---|
| 3,515,070 | A | * | 6/1970 | Cutler et al. | 102/513 |
| 3,736,874 | A | * | 6/1973 | Gerber | 102/513 |
| 3,774,022 | A | * | 11/1973 | Dubrow et al. | 102/336 |
| 3,940,605 | A | * | 2/1976 | Gerber | 102/513 |
| 4,553,481 | A | * | 11/1985 | Ricci | 102/458 |
| 4,706,568 | A | * | 11/1987 | Lundwall et al. | 102/513 |
| 5,018,450 | A | * | 5/1991 | Smith | 102/513 |
| 5,027,710 | A | * | 7/1991 | Wittmann et al. | 102/513 |
| 5,546,863 | A | * | 8/1996 | Joslyn | 102/513 |
| 2001/0045173 | A1 | * | 11/2001 | Gibson et al. | 102/513 |

* cited by examiner

*Primary Examiner*—Harold J. Tudor
(74) *Attorney, Agent, or Firm*—John F. Moran; Michael C. Sachs

(57) ABSTRACT

A flameless tracer and marker for small munitions and canon caliber projectiles incudes non-toxic, environmentally friendly chemiluminescent materials which are maintained in separate compartments is described. The munitions when fired glow intensely for several minutes and mark a target area upon impact.

10 Claims, 4 Drawing Sheets

FLAMELESS TRACER AMMUNITION

RELATED APPLICATIONS

This application claims benefit under 35 USC 119(e) of provisional application No. 60/337,751 filed Dec. 4, 2001, the entire file wrapper contents of which application are hereby incorporated by reference as though fully set forth herein at length.

U.S. GOVERNMENT INTEREST

The inventions described herein may be made, used, and licensed by the U.S. Government for U.S. Government purposes.

FIELD OF THE INVENTION

This invention relates to munitions employed for training and tactical purposes more particularly, the present invention relates to novel small arms, mortar and canon caliber munitions including a flameless tracer containing chemiluminescent chemicals capable of providing flight path trace and site identification.

BACKGROUND OF THE INVENTION

In both military and non-military organizations, it has been common practice in training and tactical exercises to employ materials capable of providing a visible trace of a projectile's trajectory after firing from a weapon, so assuring that the projectile has been delivered to its desired target site and its flight path traced from gun tube to target. The tracer is required to be seen by the observer either during daylight or night time. The pyrotechnic compositions employed as tracers in such applications are typically loaded into the back end of the projectile and are made of pyrotechnic materials that burn and create light. After the projectile (round) is fired from the weapon, the tracer ignites (burns) and a visible light can be seen as the projectile travels to its target. The gunner and/or observer can actually see the trace of the projectile flight and, subsequently, adjusts the weapon so that the next round fired can impact the desired target location. Pyrotechnic compositions suitable for such purpose may be chosen from among those well known in the art such as strontium nitrate, magnesium powder, potassium nitrate, barium nitrate and the like.

Although such prior art methods have met with some degree of success, workers in the art have encountered certain difficulties. Thus, for example, tracer ammunition has frequently resulted in fires on training ranges which have been attributed to energetic material tracers contacting and burning surrounding brush and other ground material. This causes additional costs to be incurred in extinguishing the fires while interrupting training exercises. Furthermore, training exercises must be extended to replace time lost, thereby incurring more manpower costs. Additionally, tracers in current projectiles contain materials which are enviromentally unfriendly and often pose environmental hazards to training areas due to their toxic emissions into the atmosphere and as a result of such materials leaching into ground water. Still further, tracer materials commonly in use must be transported and the pyrotechnic nature and explosive properties add significant costs.

Recently, a new development in the preparation of powdered chemiluminescent materials meeting U.S. Army requirements occurred as a result of private research by the Omniglow Corporation of West Springfield, Massachusetts. These materials were obtained by mixing an oxalate ester in powdered form with a liquid peroxide to form a light emitting slurry. These chemiluminescent materials have been found suitable for use in tracer applications as well as for identifying and marking a target area with visible and/or infrared light sources. The materials so obtained are similar to conventional chemiluminescents, however, certain ingredients and manufacturing techniques were developed by them working in conjunction with the inventors herein to obtain the capability of long duration and high light intensity tracing and marking capability not available heretofore. The oxalate component employed was in powdered form which when mixed with a liquid peroxide yielded a non-toxic slurry which was found to be non-flammable and biodegradable.

The physical form of the chemiluminescent materials employed herein accounts for several advantages over the prior art, so permitting new applications. Thus, for example, the powdered form of chemiluminescent permits long term storage of materials without leakage. These compositions can readily be contained in a projectile, the powder being surrounded by one or more vials of liquid. Upon gun launch, the chemicals mix, so creating light and a trace of the path of the projectile which breaks apart at which time the material is scattered on the target area. This action effectively marks the target area with greater light intensity and for longer durations than those attainable using standard all liquid chemiluminescent chemical systems. The primary limitation with the all liquid systems has been that upon dispersal to the environment such as a ground or target impact area, the liquid chemicals tend to be absorbed by the impacted materials such as dirt, fabric, plants and the like. In marked contrast thereto, the described composition which is in the form of a powdered slurry when fully mixed is not absorbed into these impacted materials and is not miscible in water. Accordingly, these compositions will mark wet locations with ease. This is a significant advance in the art since it was common for the liquid chemiluminescent materials to be easily washed away, or, alternatively, react with the oxygen in the air, thereby limiting light output duration. The described compositions include components which preclude reaction with oxygen, so permitting marking of an area with longer and greater light intensity, so suggesting their use for marking, illuminating, training and site identification applications.

In order to fully appreciate the wide range of applications of the instant invention, the following environments have been found suitable:

(1) As an environmentally friendly tracer in projectiles using powdered chemiluminescent infrared and/or visible light source.

(2) As a flameless tracer in projectiles using powdered chemiluminescent infrared and/or visible light source which will not start fires.

(3) Projectiles containing powdered chemiluminescent chemicals can be used to identify and mark a target (ground location, enemy equipment or vehicles) with a chemiluminescent infrared light and/or visible light source of long duration and durability after impact and deposition of the chemiluminescent slurry on the object, so permitting identification of impact areas.

(4) Missiles and smart munitions which contain infrared seeking sensors can home in on an identified (chemiluminescent marked) target and thereby guide a munition to its target.

(5) Chemiluminescent light sources, visible and infrared, delivered by projectiles can be used to illuminate caves, equipment, booby traps, enemy vehicles, projectile impact areas and personnel. The chemiluminescent material is not flammable and will not ignite any dangerous explosive gases inside a cave. Infrared light source provided by these materials allows personnel to look into a cave with infrared (night vision) detection devices to a much greater depth than attained hereto fore. Current night detection devices are only capable of detecting temperature differences. Booby traps which are deeply embedded in a cave and would be at the same temperature as the cave would not be detected by night vision devices without marking with an infrared chemiluminescent chemical projectile.

(6) Directing a unit in battle to concentrate their projectiles into a marked area. This area would be marked by visible and/or infrared chemiluminescent light when dispersed from a projectile. This visual signal is an effective method to get the attention of soldiers during battle because battle noise interferes with communication. In this manner, the fighting unit is more efficient in defeating an enemy.

Thus, it is an object of the present invention to fabricate novel tracer and marker ammunition including chemiluminescent materials capable upon mixture of creating intense displays visible over long ranges after gun launch.

It is also an object of the present invention to obtain an improved method for manufacturing tracer ammunition which is environmentally friendly and which imposes no burdensome shipping restrictions.

SUMMARY OF THE INVENTION

In accordance with the present invention, these prior art limitations have been effectively obviated by means of a novel flameless tracer and marker. More specifically, the invention involves the fabrication of a flameless tracer and marker for small munitions and canon caliber projectiles including non-toxic, non flammable, non-energetic, environmentally friendly chemiluminescent chemicals which are maintained in separate compartments or in a single compartment until light is needed.

BRIEF DESCRIPTION OF THE DRAWING

The invention will be more fully understood by reference to the following detailed description taken in conjunction with the accompanying drawing wherein.

DETAILED DESCRIPTION OF THE INVENTION

Figure 1A:
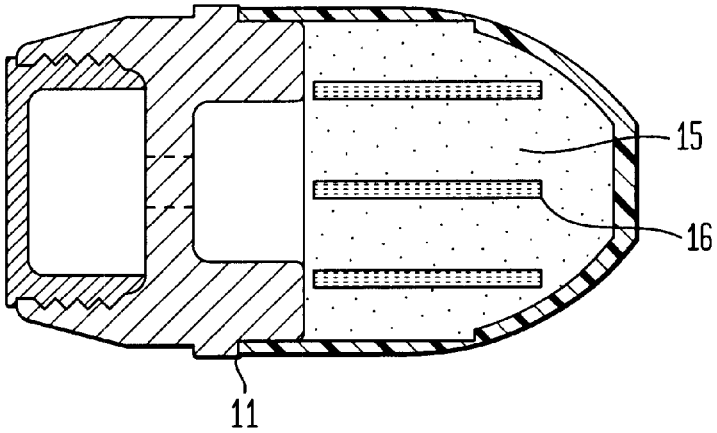
FIG. 1A is a cross-sectional view of an assembled 40 MM M781 projectile that has been modified in accordance with the present invention.
Figure 1B:
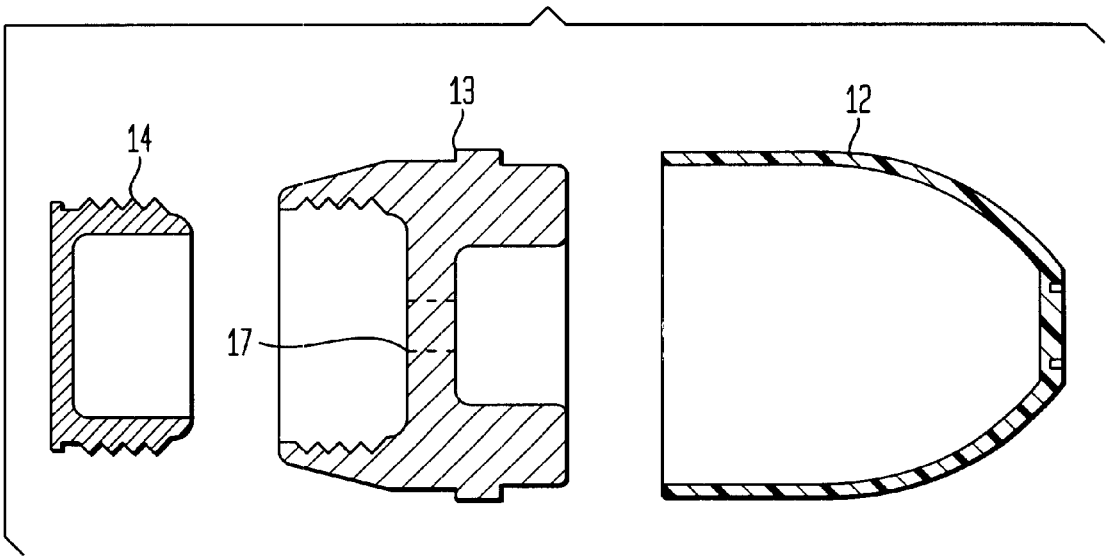
FIG. 1B is an exploded view of the projectile of FIG. 1A.

With reference now more particularly to FIGS. 1A and 1B, there is shown a typical 40 MM tracer or marker (M781) cartridge or a projectile that is loaded into the cartridge of the invention. Shown in FIGS. 1A and 1B is cartridge or projectile 11 including a hollow front end 12 comprising a plastic windshield, a projectile metal body 13, and an optional rear plastic windshield 14.

In the practice of the invention, one or more glass or plastic vials 16 containing a liquid peroxide is disposed in hollow front end 12. Following, an oxalate powder 15 is placed between the vials 16 and fills the balance of the space in front end 12.

The windshield employed may either be opaque, transparent or translucent dependent upon the desired use. Thus, one requiring a tracer will employ a transparent or translucent windshield whereas one requiring only a site identification of the target area will employ an opaque windshield. As noted, the use of a rear windshield which may be threaded to fit body 13 is an optional feature. 17 is an optional aperture which allows chemiluminescent chemicals (or chemiluminescents) to flow into rear windshield 14 during activation of the device.

The environmentally friendly chemicals employed for this purpose are compositions commonly employed in industry in the fabrication of glow sticks which light up safety devices. These compositions typically comprise an oxalate ester in combination with a peroxide, the chemicals being kept separate and apart until the light is required at which time mixture thereof is effected by breaking a seal which separates them. It should be noted that vials 16 break only on setback impact at which time the peroxide mixes with the oxalate ester to form a slurry which serves to mark the target area.

Figure 2A:
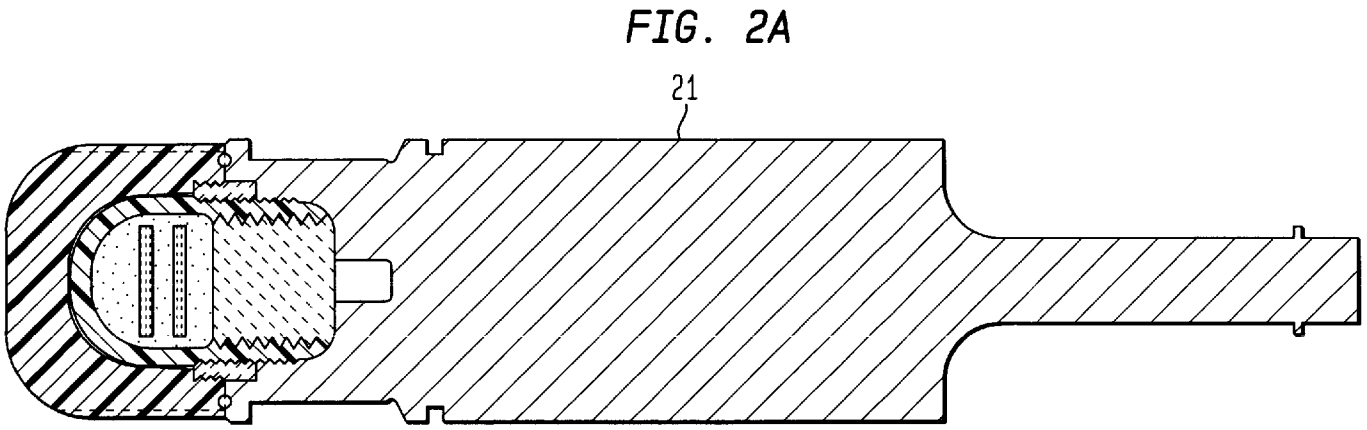
FIG. 2A is a cross-sectional view of an assembled 120 MM M831A1 tank projectile that has been modified in accordance with the present invention.
Figure 2B:
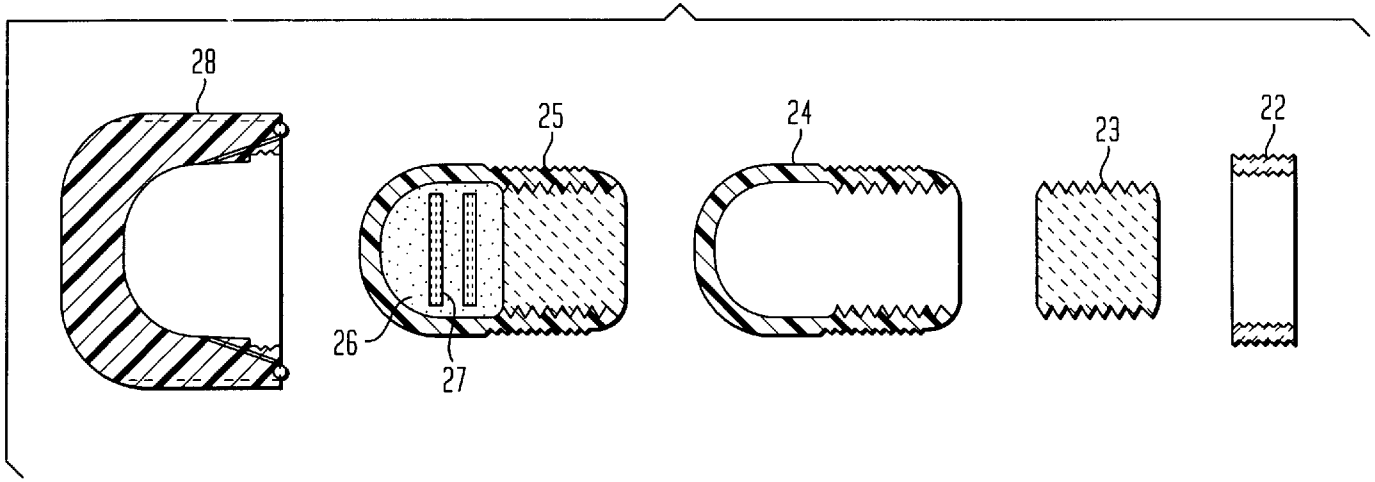
FIG. 2B is an exploded view of the projectile of FIG. 2A.

With reference now to FIGS. 2A and 2B, there is shown a side view in cross-section of a 120 MM M831A1 tank projectile in accordance with the present invention. Shown in the Figures is tank projectile 21 including a hollow tracer cup 25 including hollow cup 24 adapted with a threaded plug 23 that permits loading of chemicals in accordance with the invention. Also shown are vials for liquid peroxide 27 and ester oxalate powder 26. An optional threaded adapter ring 22 may be used if desired. An optional protective tracer cup 28 may also be employed.

The materials so activated by the firing and admixture glow intensely. The glowing tracer material contained in a see-through enclosure glows intensely during the 6–10 seconds of flight of the device before impact with the ground.

These chemical compositions, as indicated typically comprise an oxalate ester and a peroxide such as hydrogen peroxide and are of the type shown and described in U.S. Pat. Nos. 4,678,606, 4,717,511, 5,122,306 and 5,232,635 which are incorporated herein by reference. The chemiluminescent materials are non toxic and may be used in the form of glow sticks which emit light and glow intensely for several minutes at ambient temperatures or as liquids contained in glass or plastic containers which fracture upon firing of the projectile.

Figure 3A:
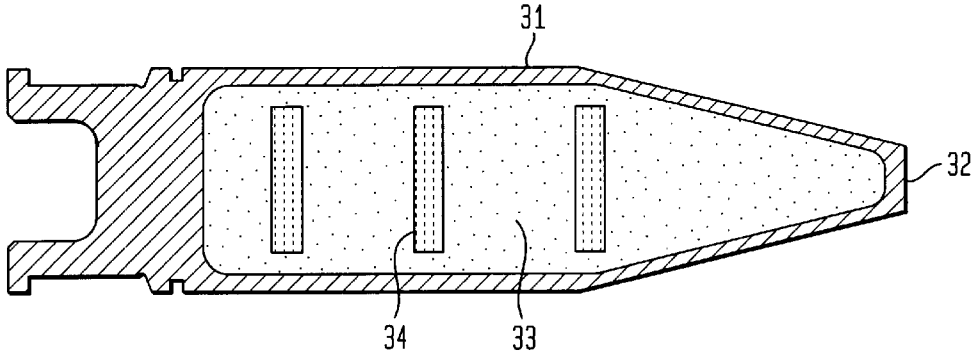
FIG. 3A is a cross-sectional view of an assembled generic 120 MM tracer/marker tank or artillery projectile that has been modified in accordance with the present invention.
Figure 3B:
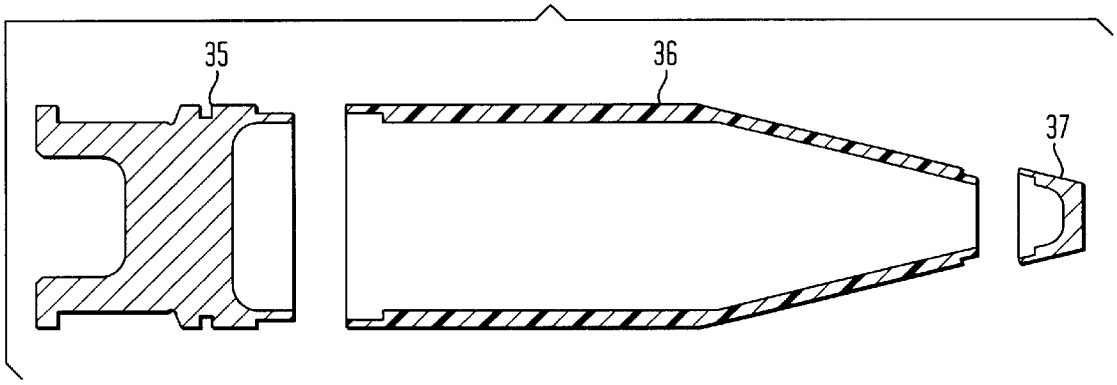
FIG. 3B is an exploded view of the projectile of FIG. 3A.

With reference now to FIGS. 3A and 3B, there is shown a tank projectile or artillery projectile 31 (i.e. 105 mm, 120 mm, 155 mm) including chemiluminescent materials contained in vials 34 and oxalate ester powder 33 loaded through cap 32. The structure also includes a transparent or translucent body 36 which is threaded or slip fit and glued into back end 35.

Figure 4A:
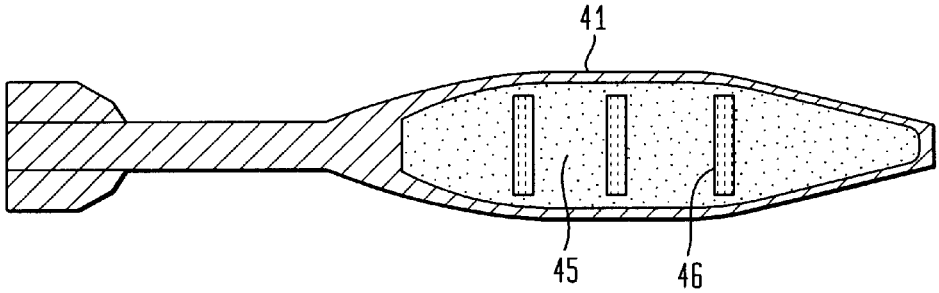
FIG. 4A is a cross-sectional view of an assembled generic Mortar projectile in accordance with the present invention.
Figure 4B:
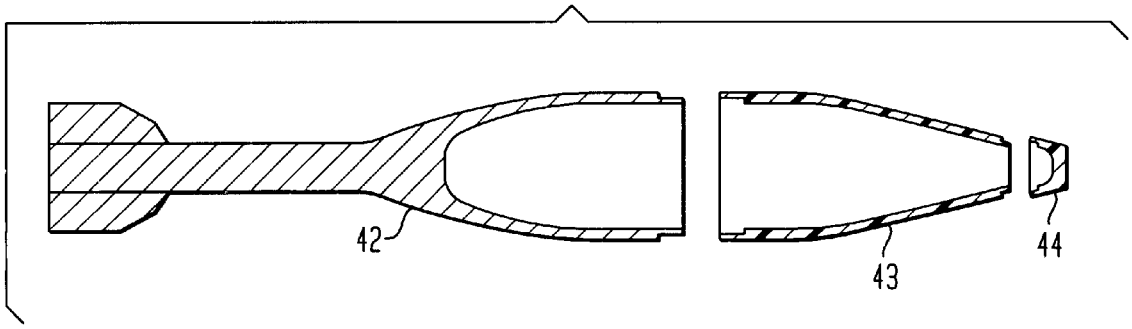
FIG. 4B is an exploded view of the projectile of FIG. 4A.

With reference now to FIGS. 4A and 4B, there is shown a generic mortar (e.g. 60 mm, 81 mm, 120 mm) projectile assembly 41 including back end 42 and a transparent or translucent body 43 including therein chemiluminescent materials comprising oxalate ester 45 and vials of a peroxide 46. Also shown is cap member 44 which encloses the top of projectile body 43.

Variations of the present invention may also be made without departing from the spirit and scope of the invention., Thus, for example, it has been found practical to employ the described concept in the fabrication of the following projectiles commonly in use for military applications: M831A1, XM1002, M865, M829A2, XM829E3, etc. Additionally, alternative configurations may be employed for containment of the chemiluminescent materials.

What is claimed is:

1. A tracer and site identification elongated projectile that provides a light trace of a trajectory of the projectile in flight, and that further provides site identification capability, including:

a hollow front end comprising a transparent or translucent plastic windshield having disposed therein:

at least one breakable vial storing liquid chemiluminescent reagents; and an oxalate ester powder surrounding the vial, wherein the vial breaks on setback impact that is exerted on the projectile during firing and initial launch, causing the liquid chemiluminescent reagents to mix with the surrounding oxalate ester powder to form a mixture that provides a lighted trace of the projectile flight, and to mark a target area when the projectile breaks upon impact with a target area, and a metallic rear projectile body attached to a rear end of said windshield.

2. The projectile in accordance with claim 1, wherein the windshield is transparent.

3. The projectile in accordance with claim 1, wherein said plastic windshield is translucent.

4. The projectile in accordance with claim 1 wherein the at least one breakable vial storing liquid chemiluminescent reagents comprises a plurality of vials that are disposed adjacent to each other.

5. The projectile in accordance with claim 1 wherein the liquid chemiluminescent reagents mix with the surrounding oxalate ester powder to provide a lighted trace of the projectile flight and to mark the target area as an infrared light.

6. The projectile in accordance with claim 1 wherein the liquid chemiluminescent reagents mix with the surrounding oxalate ester powder to provide a lighted trace of the projectile flight and to mark the target area as a visible light.

7. The projectile in accordance with claim 1 wherein the lighted trace is non-flammable and does not start a fire upon impact with the target area.

8. The projectile in accordance with claim 1 wherein the lighted trace is environmentally friendly.

9. The projectile in accordance with claim 5 wherein a marked target area becomes a homing device to guide a munition to the market target area.

10. A tracer and site identification elongated tank projectile that provides a light trace of a trajectory of the projectile in flight, and that further provides site identification capability, including:

a body member having disposed in a rear portion thereof:

(a) a hollow transparent or translucent tracer cup held in place by means of a threaded ring secured to said body member and said tracer cup and having disposed therein a plurality of closely distanced vials storing liquid chemiluminescent reagents, and an oxalate ester powder surrounding the vial, wherein the vial breaks on setback impact that is exerted on the projectile during firing and initial launch, causing the liquid chemiluminescent reagents to mix with the surrounding oxalate ester powder to form a mixture that provides a lighted trace of the projectile flight, and to mark a target area when the projectile impacts the target area, and (b) a transparent or translucent protective tracer cup over an end of said hollow tracer cup and secured to said hollow tracer cup and said body member by said ring.

* * * * *